United States Patent [19]

Vidler

[11] Patent Number: 4,974,296

[45] Date of Patent: Dec. 4, 1990

[54] APPARATUS FOR CORRECTING IRREGULARITIES IN A TEXTILE STRAND

[75] Inventor: Michael A. Vidler, Taylors, S.C.

[73] Assignee: Platt Saco Lowell Corporation, Inc., Greenville, S.C.

[21] Appl. No.: 484,600

[22] Filed: Feb. 23, 1990

[51] Int. Cl.[5] ..... G01D 3/04; D01H 5/32

[52] U.S. Cl. ..... 19/239

[58] Field of Search ..... 19/239, 89, 145.5; 324/694, 107, 636

[56] References Cited

U.S. PATENT DOCUMENTS

| | | | |
|---|---|---|---|
| 4,267,620 | 5/1981 | Allen, Jr. | 19/239 |
| 4,302,968 | 12/1981 | Moser | 19/239 |
| 4,512,061 | 4/1985 | Hartmannsgruber et al. | 19/239 |
| 4,623,835 | 11/1986 | Mehdizabeh et al. | 324/632 |
| 4,710,700 | 12/1987 | Osaki et al. | 324/632 |
| 4,812,993 | 3/1989 | Konig et al. | 19/239 |
| 4,864,694 | 9/1989 | Konig et al. | 19/239 |
| 4,894,609 | 1/1990 | Fujiki et al. | 324/142 |
| 4,908,910 | 3/1990 | Pinto et al. | 19/145.5 |
| 4,925,474 | 5/1990 | Grundy | 324/694 |

FOREIGN PATENT DOCUMENTS

| | | | |
|---|---|---|---|
| 183632 | 12/1964 | U.S.S.R. | 19/239 |
| 2061338 | 5/1981 | United Kingdom | 19/239 |
| 2081758 | 2/1982 | United Kingdom | 19/239 |

*Primary Examiner*—Werner H. Schroeder
*Assistant Examiner*—John J. Calvert
*Attorney, Agent, or Firm*—Bailey & Hardaway

[57] ABSTRACT

An apparatus for correcting irregularities in a moving textile strand utilizes sensors B and C making measurements reflecting variations in capacitance of a moving textile strand, and a computer E supplying data reflecting the characteristics of the strand as a result of varying moisture content in a similar strand for reducing the effect of moisture contained in the strand upon the measurements and upon an autoleveller controlling the strand in response to said measurements.

16 Claims, 3 Drawing Sheets

APPARATUS FOR CORRECTING IRREGULARITIES IN A TEXTILE STRAND

BACKGROUND OF THE INVENTION

This invention relates to apparatus for correcting irregularities in a textile strand utilizing a capacitance related transducer wherein the effects of moisture content are compensated for.

Drawing frames perform a doubling process, which drafts or attenuates and reduces a number of incoming textile slivers, typically eight, to a single output or delivery sliver. This may be considered to be an averaging function by which the magnitude and length of thick/-thin variations in the incoming sliver are reduced in the outgoing sliver.

In addition, drawing frames frequently include a levelling function. In levelling, the lineal mass of the incoming or the outgoing sliver, or both, is measured by an appropriate transducer. The output signal voltage is used to control a motor which corrects the drawing frame's draft ratio. This in turn regulates the uniformity of the output sliver.

The uniformity of the drawing frame's output lineal density is critical to the efficiency of down stream mill processes, and to the quality of the dependent textile yarn or fabric products.

Both the control of the sliver weight, and the measurement of its uniformity are dependent on suitable transducers or sensors. The sensing methods commonly used for these purposes have disadvantages in both accuracy and consistency. Volumetric methods include the tongue and groove roller or displacement method, and the air trumpet or pneumatic method. These methods rely on the measurement of physical or mechanical attributes of the fiber which while related to the lineal density, are subject to error.

The tongue and groove method is subject to variations in the resilience or compressibility of the fiber, and to the form factor or shape of the sample under compression. This method also disrupts the desirable laminar flow of fiber into the drafting zone when used as the in-feed sensor.

The air trumpet method uses the air entrapped in the sliver as a measure of its lineal density. When the sliver is passed through a restricted orifice, an air pressure is generated which is related to the density. However, the pressure is also dependent on the fiber velocity and on the fineness or micronaire of the fiber. The orifice may be fouled by oils and other materials borne by the fiber, particularly in the case of cotton. Other methods which have been proposed in this category are subject to similar disadvantages. These include measurement of the force required to pull the delivery sliver through the trumpet, and measurement of the audio-frequency noise, or the heat generated due to friction in the same area.

Another class of sensing which has been tried is the simple capacitive method as heretofore used. This method depends on the dielectric characteristic of the fiber. As fiber passes through the sensing zone, it replaces the air forming the dielectric of a capacitor, causing an increase in the effective dielectric constant, which is dependent on the amount of fiber present. This in turn causes a change in the capacitance value, which is detectable by a variety of electronic means, in order to produce an output voltage related to the lineal density of the sliver. However, many fibers, particularly cotton contain moisture, the dielectric constant of which is eight to ten times that of the fiber. Small changes in the moisture content thus cause major changes in the apparent dielectric constant, and hence in fiber weight measurements. This method is also subject to ambient temperature changes. Capacitive sensing has, however, been successfully applied in reading the rate of change of the lineal density as opposed to its absolute level.

U.S. Pat. Nos. 3,155,898, 3,155,900, 3,155,901, 3,155,902, 3,241,062, 3,290,588, 4,208,625 and 4,568,875 disclose detectors utilizing capacitance measurements.

Another class of sensor used in industry for true mass sensing is the beta gauge. This method uses a radiation source. However, the cost factors do not justify its use for textiles in its present form.

SUMMARY OF THE INVENTION

The invention contemplates the provision of suitable apparatus and method for leveling a textile strand utilizing a moisture corrected capacitance measurement of the lineal density of a sliver and the like. The invention provides suitable means for the measurement corrected for variations in moisture content and control of lineal density of a textile strand, for example, sliver or tow, or other fiber structures capable of being drafted.

Moisture corrected capacitance sensing can be utilized in several conventional leveller drawing frame applications. An advantage of moisture corrected capacitive sensing of the present invention is that it can be arranged to sense incoming slivers either individually or as a group. Further, it is unnecessary to compress or distort the fiber.

A number of capacitance measuring devices and methods have been described by which the effects of moisture can be eliminated such as those disclosed in the above patents. Generally such methods use in one way or another, the fact that the effect of the moisture changes with the frequency of the excitation of a capacitive bridge. Systems employing two or more frequencies are known. For a given material, there are specific mathematical relationships between the actual weight of the material including moisture, the moisture content, and the apparent capacitance of the capacitor through which the material is passing, when measured at various excitation frequencies.

The invention contemplates utilizing data reflecting the characteristics of a strand being processed upon a drawing frame and the like, collected as a result of measuring variations in moisture content and its effect upon strands of similar material, for reducing the effect of variations in moisture content upon capacitive measurements for correcting irregularities in the textile strand being processed. Thus, the invention contemplates using the data reflecting the true fiber content of the strand, to regulate the leveling process in such a way as to minimize the effects of variations in moisture content upon the lineal density. The term irregularities refers to variations in weight per unit length.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate a drawing frame having a drafting system A moving a textile fiber strand in the form of a sliver. Apparatus for correcting irregularities in the textile fiber strand includes an input capacitance sensor or transducer B and an output capacitance sensor or transducer C adjacent the moving fiber strand making measurements reflecting variations resulting from the irregularities. Electrically operable means D are provided for reducing the effect of moisture contained in the strand upon the measurements. A computer E supplies data to the electrically operable means reflecting the characteristics of a strand similar to the strand being processed as a result of varying moisture content. An autoleveller F has a servo motor operable responsive to the electrically operable means for controlling the speed of the drafting system is provided for correcting irregularities in the strand. The sensors B and C each include a bridge circuit reflecting variations in capacitance. Fiber strands are combined and attenuated into a single sliver.

Figure 1:
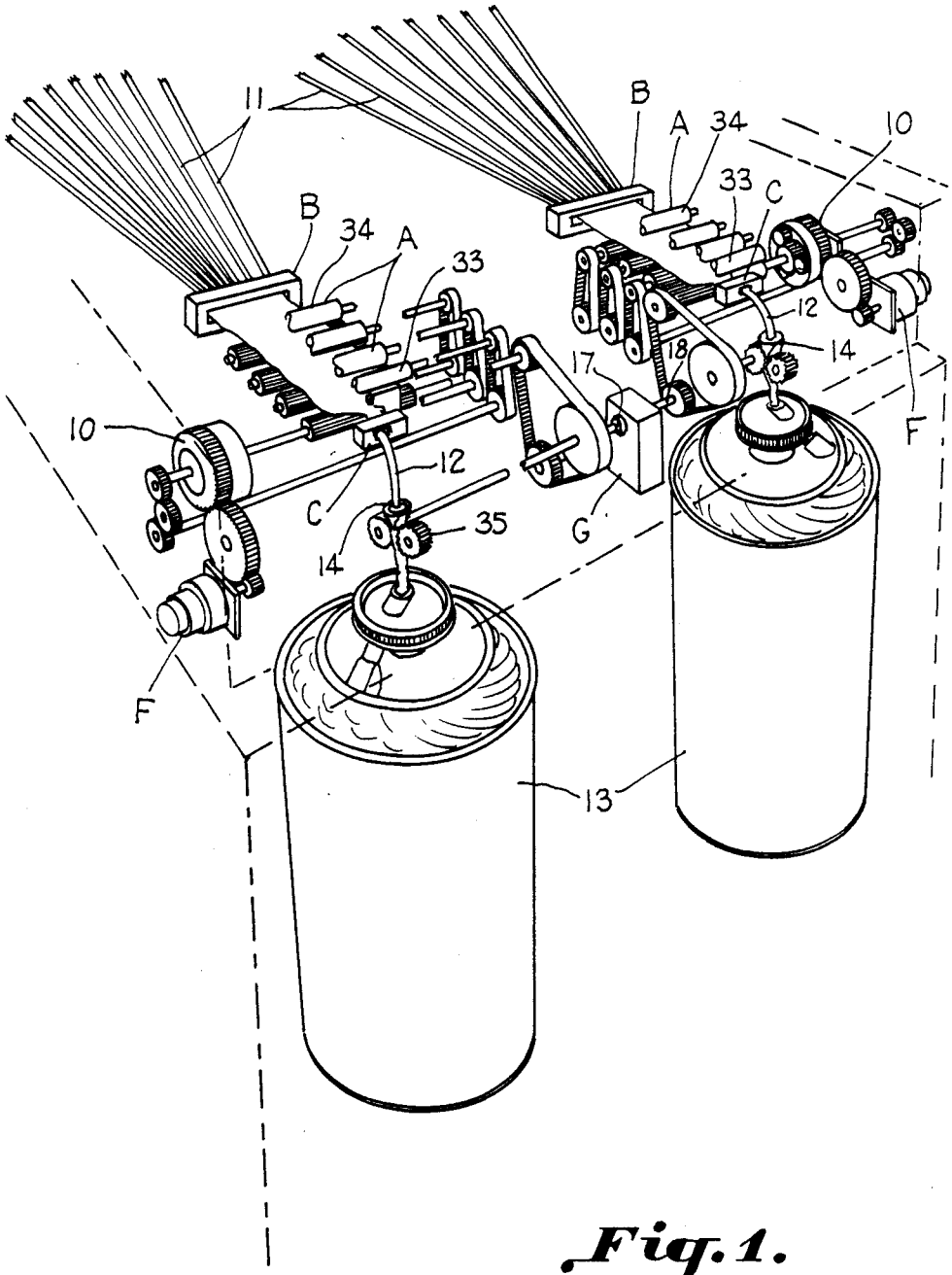
FIG. 1 is a perspective view of a drawing frame equipped with apparatus for correcting irregularities in the strand in accordance with the invention.

FIG. 1 illustrates an embodiment of the invention applied to a drawing frame. In addition to a main drive motor, the servo motor F, through a suitable gear box including gears 10, drive the drafting systems A. The input capacitive sensors B are illustrated for accommodating the eight strands 11 combined to form the output or delivery strand 12 which is accommodated by the output capacitive sensor C. The slivers 12 are delivered into the usual sliver cans 13 through the trumpets 14.

The multiple in feed slivers 11 may be individually sensed and their signals averaged. An advantage is that the slivers may be subject to less damage than if they were passing through a single larger sensor and that they may be more favorably aligned with the drafting element.

Figure 2:
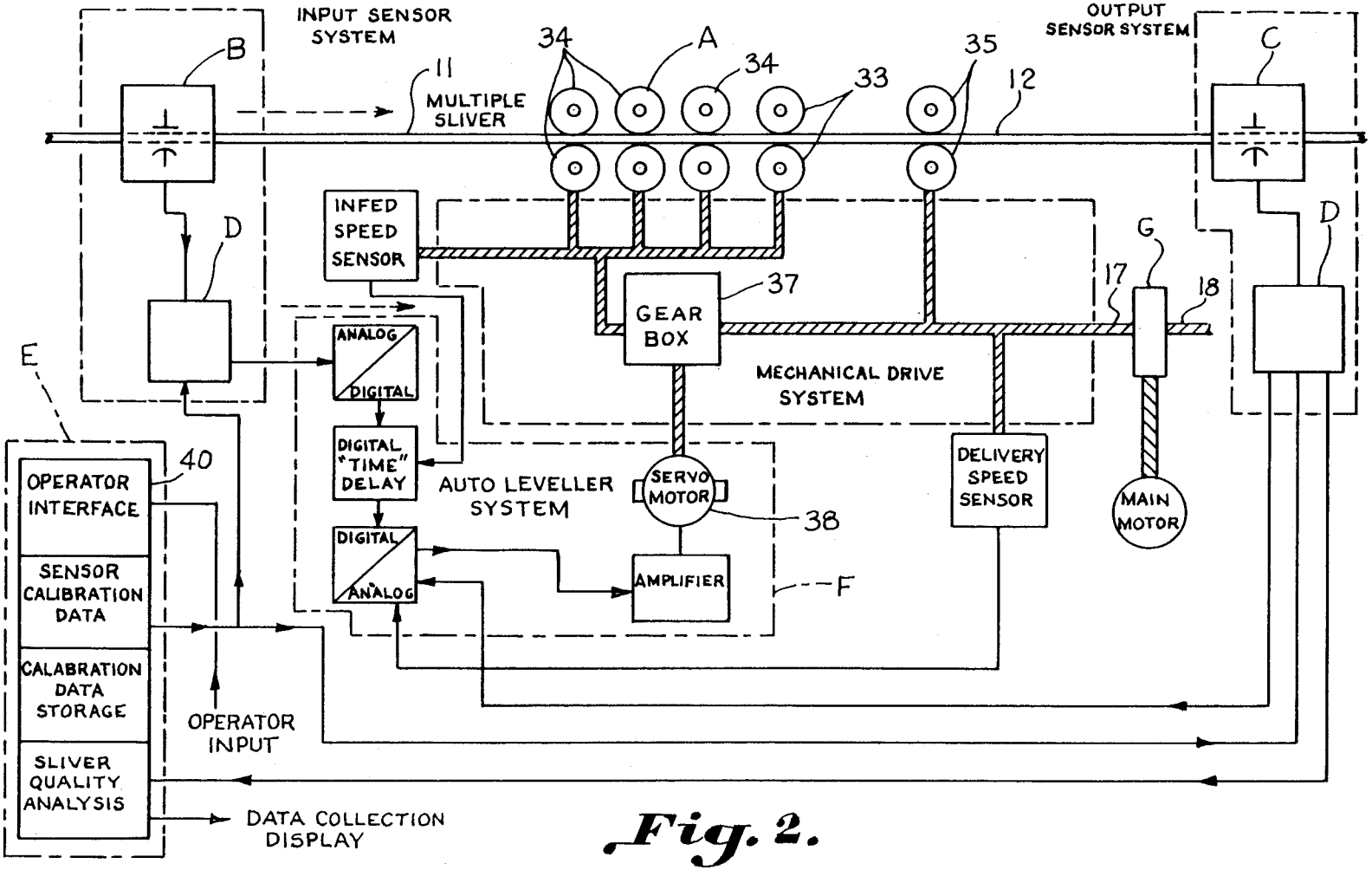
FIG. 2 is a schematic diagram illustrating the components of the apparatus illustrated in FIG. 1.

The main motor is shown in FIG. 2 as driving a transmission G which has an output 17 to a single sliver delivery. The output 18 is to another sliver delivery.

The output from the bridge, which includes fixed capacitors 15 and variable capacitors 16, is balanced at zero voltage with no sliver present. The presence of sliver in capacitors 16 causes the bridge to become unbalanced producing an output voltage referred to herein as unbalance voltage output. This bridge unbalance voltage output will vary in amplitude with fiber mass present, fiber moisture content and frequency of bridge excitation. The effect of moisture is greater at low frequencies for example in the kilohertz range than at high frequencies in the megahertz range. Curves (not shown) are plotted for fiber samples of given materials, showing actual sample weight, bridge unbalance voltage at a high frequency, and bridge unbalance voltage at a low frequency, as a function of the actual moisture weight percentage in the samples. These are used as calibration curves for the particular fiber materials. Subsequently, the mathematical functions describing these curves are stored in the computer. The bridge unbalance voltages measured for other samples of the same type of material may be combined with the curve data, to derive their moisture content and moisture corrected mass. Thus, data is available reflecting characteristics of a similar strand for use in controlling irregularities in the strand being processed. A number of derivation methods are possible, some of which are described in the contexts in the patents listed herein.

Figure 3:
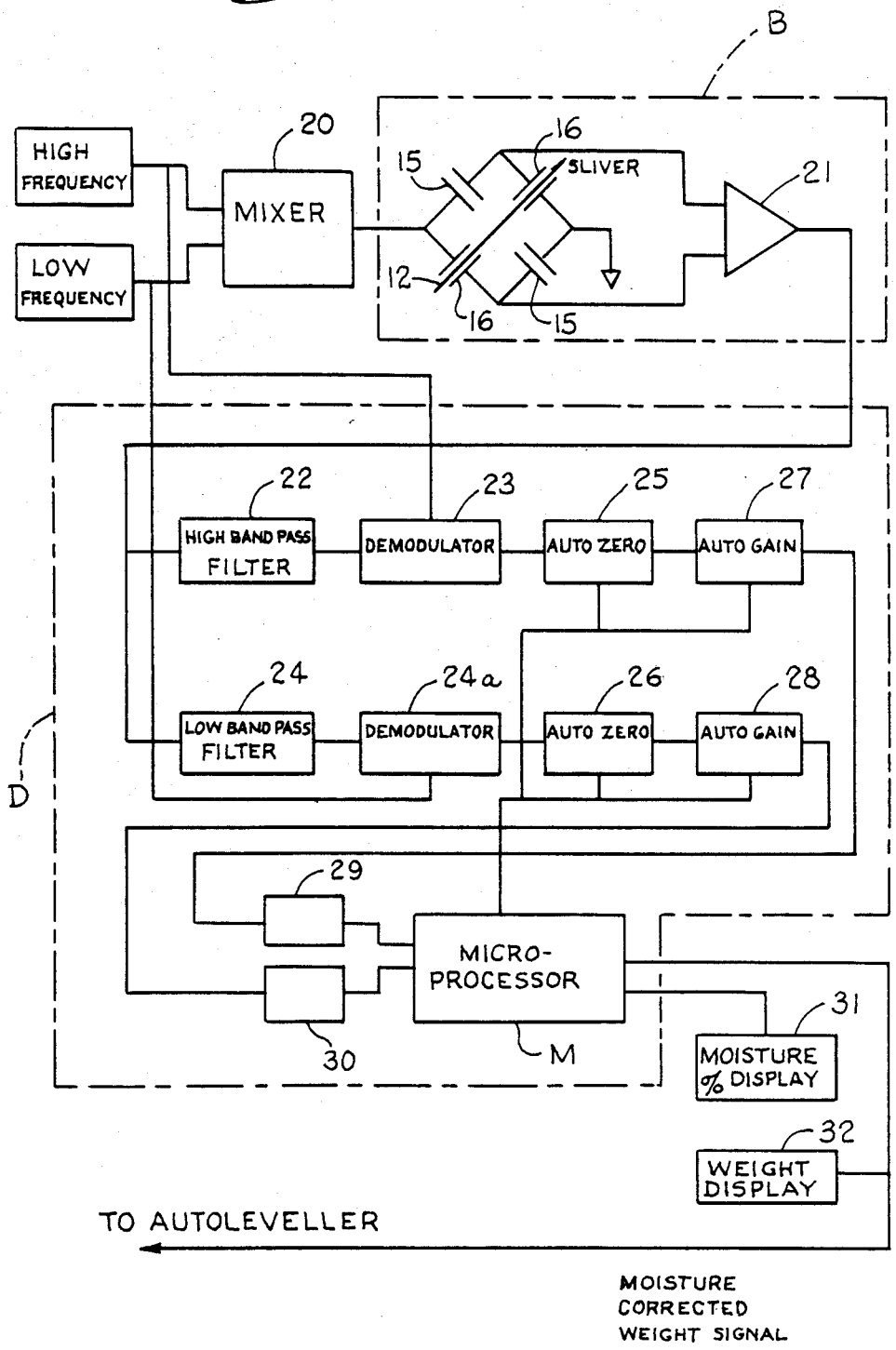
FIG. 3 is a block diagram further illustrating the sensing mechanism and associated parts.

FIG. 2 further shows the input sensor system which includes the transducer B and associated signal conditioning system D. An output or delivery sensor C has signal conditioning circuitry D' which is similar to the signal conditioning circuitry D associated with the input sensor B. FIG. 3 illustrates the circuitry associated with the sensor B.

In the present embodiment of the invention the high frequency and the low frequency excitation voltages are combined by a mixer 20 (FIG. 3) into a composite waveform containing both, although configurations in which the high and low frequencies are applied to separate transducers would be also useful. The unbalance voltage described above will also contain proportions of both the high and low excitation frequencies. The unbalance voltage is read differentially by a differential amplifier 21, thus minimizing the effect of excitation voltage amplitude, temperature, and other drift factors.

The high frequency component of the AC unbalance signal is extracted from the composite by the high frequency bandpass filter 22. This is routed to the high frequency synchronous demodulator 23, where the signal is converted to DC voltage representing the high frequency unbalance voltage.

Similarly the low frequency component is extracted by the low frequency bandpass filter 24 and is routed by the low frequency synchronous demodulator **24*a*** where the signal is converted to DC representing the low frequency unbalance signal.

Both DC unbalance signals are now processed by essentially similar components as follows. Components represented by the blocks 25 and 26 provide means for automatically correcting for transducer offset zero changes. The components of blocks 27 and 28 provide for automatic correction of transducer sensitivity and the like. The components of blocks 29 and 30 act as analog to digital converters which convert the DC voltage signals to digital quantities which may be processed by the microprocessor M.

Outputs of the microprocessor M representing the moisture corrected weight, and the fiber moisture percent are generated. These may be either analog or digital in form, depending on the nature of the drawing frame control system. The moisture corrected weight signal is in turn fed to the appropriate drawing frame autoleveller circuit to effect correction of the drafting constant, thus controlling delivered sliver weight. Moisture percent and corrected fiber weight values can be displayed if desired at displays 31 and 32.

The drafting rolls include a front roll pair 33 (FIG. 1) which runs at a constant speed thus controlling the delivery rate. The three back roll pairs illustrated as 34 operate at a variable rate depending on the draw or fiber mass reduction desired as the fiber passes through the drafting system. Fiber mass is drawn out, or reduced, by virtue of the different surface speeds existing at each roll set. Drive for the front rolls 35 and calendar rolls 14 is derived directly from the machine main motor.

The back rolls have typically small speed differentials, and are driven through the differential gearbox 37. Speed may be added to or subtracted from the back rolls, as a group, by the secondary input to the differential gear, to which is coupled the servo motor 38 of the autoleveller F. When no correction is required, the servo input will remain stationary. Positive or negative correction depends on the rotational direction of the servo motor.

Typically eight slivers enter at the back of the system, and a single sliver exits at the front. Thus, approximately the infeed rate is one-eighth of the delivery rate. The servo motor is usually capable of adjusting this ratio by at least +/−20%.

The autoleveller system F uses the sliver sensor inputs to compute the necessary speed adjustment of the servo motor 38. When using the feed side sensor, the leveller uses the input from the feed rate sensor to compute a signal delay which synchronizes the servo correction with the arrival of the measured fiber at the drafting system. This is not necessary for the delivery side sensor since it is located down stream of the draft zone.

The autoleveller operates so as to balance the equation:

$$M\ in \times V\ in = M\ out \times V\ out.$$

Where

M in is mass of input fiber.

M out is mass of output fiber.

V in is input fiber velocity.

V out is output fiber velocity.

The mass terms are provided by the appropriate feed or delivery side capacitive sensors.

V out is typically constant, and V in is a calculated signal directly controlling the servo to correct feed velocity.

The operator interface 40 of the computer E (FIG. 2) provides means whereby the operational criteria for the drawing frame can be selected or entered. These include operating speed, desired sliver weight, in-feed material and blend, etc. Appropriate information is transmitted to the computer and other drawing frame systems.

The operator interface also provides a path for entry and storage of material calibration data, and a point for analysis of sliver quality data which has been collected from the delivery sensor during operation. Connection means are also provided for transmission of sliver quality data to a central data collection system.

Measurements may also reflect variations in the "loss factor" of the capacitor. Electrically, the loss can be represented as a resistor in series with a perfect capacitor. If used as a measurement in apparatus and method according to the present invention, the value of the loss factor will change with the amount of moisture present and other characteristics.

Thus, the invention further contemplates capacitive sensing methods sensitive to variations in the dielectric characteristics of the said strand, which relate to the type, density, and moisture content of the strand material. By appropriate use of voltages representing the dielectric characteristics, lineal density errors caused by fiber moisture content are corrected.

It is thus seen that irregularities in a sliver may be corrected utilizing capacitance related measurements. Other moving textile fibers having irregularities which may be likewise corrected through drafting include fiber webs, batts, fibers in a duct, and the like, and such may be considered to be strands as contemplated in the claims.

While a preferred embodiment of the invention has been described using specific terms, such description is for illustrative purposes only, and it is to be understood that changes and variations may be made without departing from the spirit or scope of the following claims.

What is claimed is:

1. Apparatus for correcting irregularities in a moving textile fiber strand comprising:

means moving said fiber strand;

a capacitance sensor adjacent said moving fiber strand making measurements reflecting variations resulting from said irregularities;

electrically operable means for reducing the effect of moisture contained in said strand upon said measurements;

a computer supplying data to said electrically operable means reflecting the characteristics of a similar strand as a result of varying moisture content; and an autoleveller operable responsive to said electrically operable means for correcting irregularities in said strand.

2. The structure set forth in claim 1 wherein said irregularities are corrected by controlling a drafting action exerted upon said fiber strand.

3. The structure set forth in claim 1 wherein said electrically operable means includes a bridge circuit containing said sensor reflecting variations in capacitance.

4. The structure set forth in claim 1 wherein said computer supplies data collected from fiber strands of similar material.

5. The structure set forth in claim 1 wherein fiber strands are combined and attenuated in a drafting system of a drawing frame into a single sliver, and an input and an output capacitance measuring sensor on each side of said drafting system is adjacent said strands and said sliver respectively.

6. The structure set forth in claim 3 wherein said bridge circuit includes a capacitor making measurements reflecting variations in capacitance measurements of said strand.

7. For use in a drawing frame having a drafting system moving a textile fiber strand, apparatus for correcting irregularities in said textile fiber strand comprising:

a capacitance sensor adjacent said moving fiber strand making measurements reflecting variations resulting from said irregularities;

electrically operable means for reducing the effect of moisture contained in said strand upon said measurements;

a computer supplying data to said electrically operable means reflecting the characteristics of a similar strand as a result of varying moisture content; and an autoleveller operable responsive to said electrically operable means for controlling the drafting system for correcting irregularities in said strand.

8. The structure set forth in claim 7 wherein fiber strands are combined and attenuated in said drafting system into a single sliver, and an input and an output capacitor sensor on each respective side of said drafting system is adjacent said strands and said sliver respectively.

9. The structure set forth in claim 8 wherein said electrically operable means includes a bridge circuit containing a pair of capacitor sensors reflecting variations in capacitance.

10. The structure set forth in claim 8 wherein said computer supplies data collected from similar fiber strands.

11. The method of correcting irregularities in a moving textile fiber strand comprising the steps of:

moving said fiber strand;

sensing said moving fiber strand utilizing a capacitance sensor so as to make measurements reflecting variations resulting from said irregularities; and correcting said measurements by reducing the effect of moisture contained in said strand upon said measurements by utilizing data reflecting the characteristics of a similar strand as a result of varying moisture contents thereon correcting irregularities in said strand responsive to said corrected measurements.

12. The method set forth in claim 11 including combining and attenuating strands in a drafting system of a drawing frame into a single sliver, and measuring input and output capacitance on each respective side of said drafting system.

13. Apparatus for correcting irregularities in a moving textile fiber strand comprising:

means moving said fiber strand;

a sensor adjacent said moving fiber strand making measurements reflecting variations resulting from said irregularities;

electrically operable means for reducing the effect of moisture contained in said strand upon said measurements;

a computer supplying data to said electrically operable means reflecting the characteristics of a similar strand as a result of varying moisture content; and an autoleveller operable responsive to said electrically operable means for correcting irregularities in said strand.

14. The structure set forth in claim 13 wherein said measurements are capacitance measurements and a plurality of frequencies are utilized to produce an output voltage.

15. The structure set forth in claim 14 including a bridge circuit producing an unbalance output voltage.

16. Apparatus for measuring irregularities in a moving textile fiber structure capable of being drafted to correct said irregularities comprising:

means moving said fiber structure;

a capacitance sensor adjacent said moving fiber structure making measurements reflecting variations resulting from said irregularities;

electrically operable means for reducing the effect of moisture contained in said fiber structure thereby providing corrected measurements; and a computer supplying data to said electrically operable means reflecting the characteristics of a similar fiber structure as a result of varying moisture content;

whereby said corrected measurements may be utilized to correct said irregularities when drafting said fibers.

* * * * *